US011506006B2

(12) United States Patent
Lymberopoulos et al.

(10) Patent No.: US 11,506,006 B2
(45) Date of Patent: Nov. 22, 2022

(54) CONTROL VALVE SYSTEMS AND METHODS FOR BLOWOUT OF SAND SEPARATION DEVICE AND HIGH INTEGRITY PRESSURE PROTECTION

(71) Applicant: SAFOCO, INC., Houston, TX (US)

(72) Inventors: David Lymberopoulos, Houston, TX (US); James Eric Amberg, Cleveland, TX (US)

(73) Assignee: SAFOCO, INC., Houston, TX (US)

( * ) Notice: Subject to any disclaimer, the term of this patent is extended or adjusted under 35 U.S.C. 154(b) by 100 days.

(21) Appl. No.: 16/938,634

(22) Filed: Jul. 24, 2020

(65) Prior Publication Data

US 2022/0025722 A1 Jan. 27, 2022

(51) Int. Cl.

| | |
|---|---|
| ***E21B 21/08*** | (2006.01) |
| ***E21B 34/08*** | (2006.01) |
| ***E21B 34/14*** | (2006.01) |

(52) U.S. Cl.

CPC ..... *E21B 21/08* (2013.01); *E21B 34/08* (2013.01); *E21B 34/14* (2013.01)

(58) Field of Classification Search

CPC ..... E21B 21/08; E21B 34/08; E21B 34/14; E21B 43/35; E21B 21/011; E21B 21/012; E21B 21/01

See application file for complete search history.

(56) References Cited

U.S. PATENT DOCUMENTS

| | | | |
|---|---|---|---|
| 4,473,459 | A | 9/1984 | Bose et al. |
| 5,526,883 | A | 6/1996 | Breaux |
| 6,089,531 | A | 7/2000 | Young |
| 6,250,605 | B1 | 6/2001 | Young |
| 6,450,477 | B1 | 9/2002 | Young |
| 6,854,704 | B1 | 2/2005 | Young |
| 7,004,445 | B2 | 2/2006 | Lymberopoulos |
| 7,028,986 | B2 | 4/2006 | Young |
| 7,293,575 | B2 | 11/2007 | Lymberopoulos |
| 7,677,526 | B2 | 3/2010 | Lymberopoulos |
| 8,763,983 | B2 | 7/2014 | Lymberopoulos et al. |
| 8,851,108 | B2 | 10/2014 | Lymberopoulos et al. |

(Continued)

FOREIGN PATENT DOCUMENTS

WO WO-2019200311 A * 10/2019 ..... B01D 21/245

OTHER PUBLICATIONS

PCT International Search Report and Written Opinion dated Oct. 26, 2021, for International Application No. PCT/US2021/037881.

*Primary Examiner* — Michael R Wills, III

(74) *Attorney, Agent, or Firm* — Patterson + Sheridan, LLP

(57) ABSTRACT

A method of blowing out debris or sand from a separation device comprises opening a second valve assembly such that the second valve assembly is not exposed to pressurized fluid from the separation device when opening. A first valve assembly is opened, wherein the first valve assembly is downstream of the separation device and upstream of the second valve assembly. Debris or sand from the separation device is blown through the first and second valve assemblies, and through a choke port of a third valve assembly. A method of closing fluid flow through a high integrity pressure protection system comprises closing a primary valve in response to detecting the over pressurization of fluid in the fluid line, and closing at least one secondary valve in response to detecting the closing of the primary valve.

35 Claims, 8 Drawing Sheets

(56) References Cited

U.S. PATENT DOCUMENTS

| | | | | |
|---|---|---|---|---|
| 9,057,448 | B2 | 6/2015 | Lymberopoulos | |
| 9,103,465 | B2 | 8/2015 | Lymberopoulos | |
| 9,163,619 | B2 | 10/2015 | Lymberopoulos | |
| 9,163,750 | B2 | 10/2015 | Lymberopoulos et al. | |
| 9,441,453 | B2 * | 9/2016 | Lymberopoulos | E21B 34/02 |
| 9,671,794 | B1 | 6/2017 | Lymberopoulos et al. | |
| 9,890,609 | B2 | 2/2018 | Lymberopoulos et al. | |
| 10,289,125 | B2 * | 5/2019 | Imel | G05B 19/042 |
| 10,544,643 | B2 | 1/2020 | Roesner et al. | |
| 10,550,665 | B1 * | 2/2020 | Golden | F16K 31/041 |
| 10,612,678 | B1 * | 4/2020 | Golden | F02M 63/0215 |
| 11,187,058 | B2 * | 11/2021 | Golden | E21B 43/2607 |
| 2012/0073670 | A1 * | 3/2012 | Lymberopoulos | F15B 20/00 137/2 |
| 2014/0345727 | A1 | 11/2014 | Gilmore et al. | |
| 2015/0292297 | A1 * | 10/2015 | Kajaria | F16K 17/16 166/250.01 |
| 2017/0285668 | A1 * | 10/2017 | Moseley | F16K 37/0041 |
| 2019/0093444 | A1 | 3/2019 | Guidry | |
| 2020/0088021 | A1 | 3/2020 | Guidry | |
| 2021/0363029 | A1 * | 11/2021 | Johns | B01D 21/302 |

* cited by examiner

CONTROL VALVE SYSTEMS AND METHODS FOR BLOWOUT OF SAND SEPARATION DEVICE AND HIGH INTEGRITY PRESSURE PROTECTION

BACKGROUND

Field

Embodiments of the disclosure relate to control valve systems and methods for blowing out solids, such as sand, from a separation device and high integrity pressure protection.

Description of the Related Art

A separation device is often used in oil and gas recovery processes to remove solids, such as sand, from a fluid stream. Over time, the separation device becomes full of the solids that are being separated out, and the solids must be blown out and removed from the separation device to ensure proper continued operation.

Additionally, these oil and gas recovery processes often involve the handling of high pressure fluid streams flowing through various pressurized devices, such as a frac tree or a separation device. It is important to have safety equipment that protects against unexpected over pressurization of the fluid streams to prevent failure and/or damage to operating equipment and potential injury to nearby workers.

Therefore, there is a need for new and improved systems and methods for blowout of separation devices and high integrity pressure protection.

SUMMARY

In one embodiment, a method of blowing out debris or sand from a separation device comprises opening a second valve assembly of a valve control system such that the second valve assembly is not exposed to pressurized fluid from the separation device when opening; opening a first valve assembly of the valve control system, wherein the first valve assembly is downstream of the separation device and upstream of the second valve assembly and in fluid communication with each; blowing debris or sand from the separation device through the first valve assembly, the second valve assembly, and through a choke port of a third valve assembly of the valve control system, wherein the third valve assembly is downstream of and in fluid communication with the second valve assembly; then closing the first valve assembly; and then closing the second valve assembly such that the second valve assembly is not exposed to pressurized fluid from the separation device when closing.

In one embodiment, a control valve system comprises a first valve assembly positioned upstream of and in fluid communication with a second valve assembly, the second valve assembly being positioned upstream of and in fluid communication with a third valve assembly; the first valve assembly comprising: a first valve actuator comprising a piston coupled to a gate valve of a first valve via a piston rod to move the gate valve between an open positon and a closed position to open and close fluid flow through the first valve; the second valve assembly comprising: a second valve actuator comprising a piston coupled to a gate valve of a second valve via a piston rod to move the gate valve between an open positon and a closed position to open and close fluid flow through the second valve; and the third valve assembly comprising: a third valve actuator comprising a piston coupled to a gate valve of a third valve via a piston rod to move the gate valve between an open positon and a closed position, wherein the gate valve of the third valve has a choke port to allow fluid flow through the third valve when in the closed position.

In one embodiment, a method of closing fluid flow through a high integrity pressure protection system comprises monitoring a fluid pressure in a fluid line; detecting an over pressurization of fluid in the fluid line; closing a primary valve of the high integrity pressure protection system in response to detecting the over pressurization of fluid in the fluid line; closing at least one secondary valve of the high integrity pressure protection system in response to detecting the closing of the primary valve; opening the at least one secondary valve when the fluid pressure in the fluid line is below an acceptable level; and then opening the primary valve in response to detecting opening of the at least one secondary valve.

BRIEF DESCRIPTION OF THE DRAWINGS

So that the manner in which the above recited features can be understood in detail, a more particular description, briefly summarized above, may be had by reference to embodiments, some of which are illustrated in the appended drawings. It is to be noted, however, that the appended drawings illustrate only typical embodiments and are therefore not to be considered limiting of its scope, for the disclosure may admit to other equally effective embodiments.

DETAILED DESCRIPTION

Figure 1:
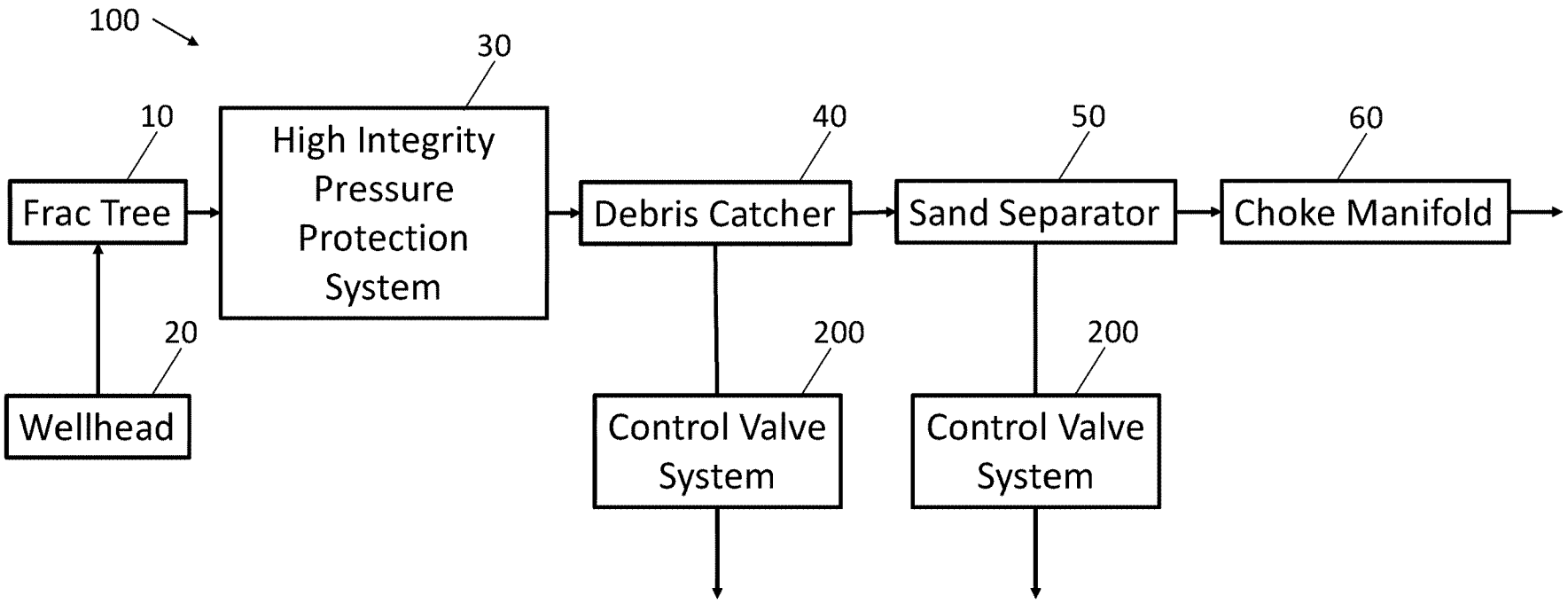
FIG. 1 illustrates an oil and gas recovery system according to one embodiment.

FIG. 1 illustrates a portion of an oil and gas recovery system 100. FIG. 1 is just one exemplary embodiment of any number of arrangements of an oil and gas recovery system and may include any number and/or type of fluid handling equipment. Such fluid handling equipment may include but is not limited to piping, connections, valves, pumps, manifolds, chokes, separators, tanks, etc., configured to process, transport, and/or store fluid streams recovered from an oil and gas reservoir.

The recovery system 100 includes a frac tree 10 that is coupled to a wellhead 20. The wellhead 20 is configured to receive a fluid stream from a wellbore that is in fluid communication with an oil and gas reservoir. The frac tree 10 directs the fluid stream to a high integrity pressure protection system 30. The high integrity pressure protection system 30 is configured to close fluid flow downstream of the protection system 30 in the event the fluid stream is over pressurized (further described below with respect to FIGS. 7 and 8).

The fluid stream then flows through a first separation device illustrated as a debris catcher 40, a second separation device illustrated as a sand separator 50, and then through a flow control device illustrated as a choke manifold 60. The debris catcher 40 is configured to remove debris from the fluid stream. Such debris may include frac plug fragments or other large solid remnants recovered from the wellbore and/or the oil and gas reservoir. The sand separator 50 is configured to remove sand from the fluid stream. The sand separator 50 may include a sand can, or other type of vessel, configured to contain sand removed from a fluid stream flowing through the sand separator 50. The choke manifold 60 is configured to control the pressure of the fluid stream and direct the fluid stream to other fluid handling equipment for further processing, transport, and/or storage.

A control valve system 200 is in fluid communication separately with each of the debris catcher 40 and the sand separator 50. The control valve system 200 is configured to blow out debris and sand from the debris catcher 40 and the sand separator 50 respectively when needed. The control valve system 200 for the debris catcher 40 may be configured to blow out a certain type or size of debris that is different from the type or size of sand that the control valve system 200 for the sand separator 50 is configured to blow out. When the debris catcher 40 and/or the sand separator 50 contains an amount of debris and/or sand that requires removal, the respective control valve system 200 is configured to blow out the debris and/or the sand in a safe and controlled manner to clear out the debris catcher 40 and/or the sand separator 50 as further described below.

Figure 2:
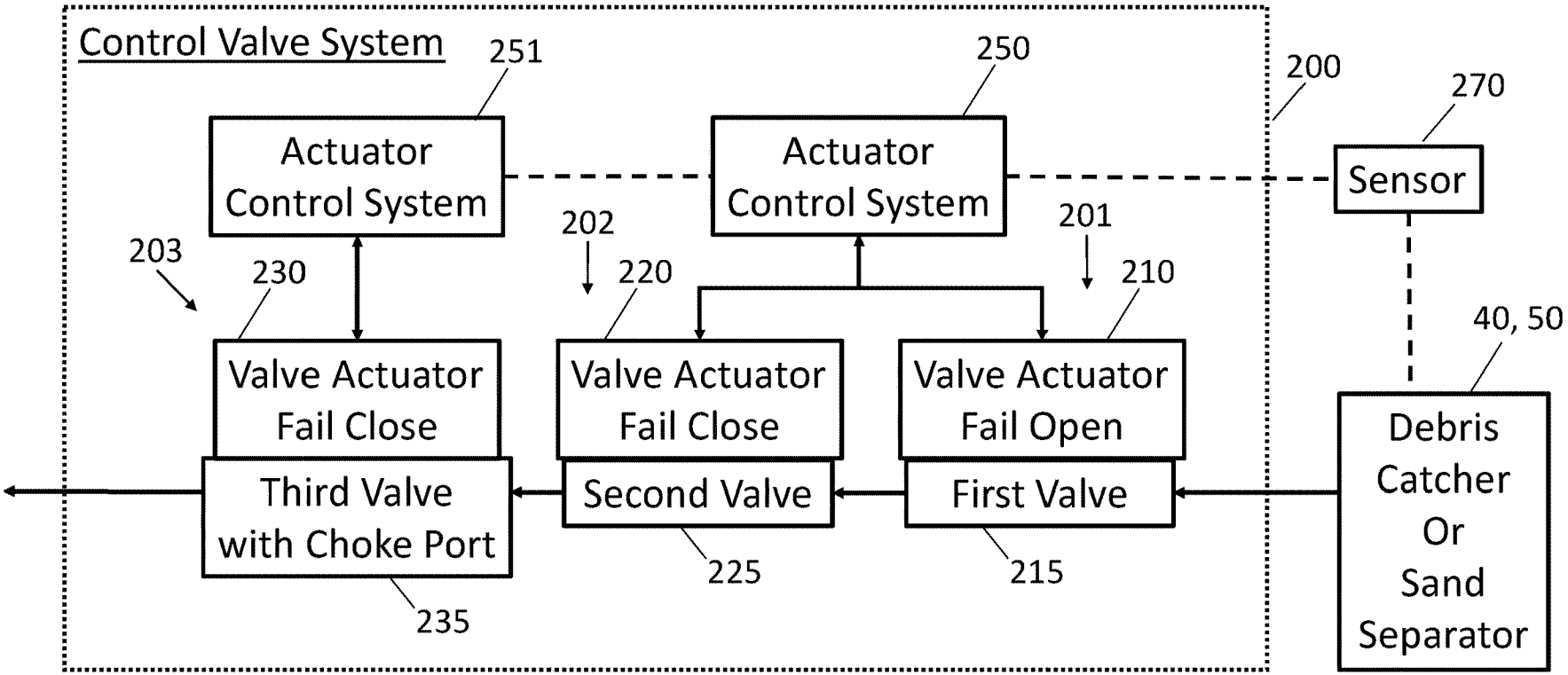
FIG. 2 illustrates a control valve system according to one embodiment.

FIG. 2 illustrates the control valve system 200. The control valve system 200 includes a first valve assembly 201, a second valve assembly 202, and a third valve assembly 203. The first, second, and third valve assemblies 201, 202, 203 are in fluid communication with each other in-series.

The first valve assembly 201 includes a first valve actuator 210 that is coupled to and configured to actuate a first valve 215 between an open position and a closed positon to allow and prevent fluid from flowing through the first valve 215. The second valve assembly 202 includes a second valve actuator 220 that is coupled to and configured to actuate a second valve 225 between an open position and a closed positon to allow and prevent fluid from flowing through the second valve 225. The third valve assembly 203 includes a third valve actuator 230 that is coupled to and configured to actuate a third valve 235 between an open position and a closed positon to allow and prevent fluid from flowing through the third valve 235.

An actuator control system 250 is configured to actuate the first valve assembly 201 and the second valve assembly 202 between the open and closed positions. An actuator control system 251 is configured to actuate the third valve assembly 203 between the open and closed positions. In one embodiment, each valve assembly 201, 202, 203 may have its own dedicated actuator control system 250, 251. In one embodiment, a single actuator control system 250, 251 can be used to actuate all three valve assemblies 201, 202, 203.

One or more sensors 270 coupled to the debris catcher 40 and/or the sand separator 50 can be used to detect when either is full or is otherwise in a condition in which a blow out of the debris or sand is required. The sensor 270 may also be used to communicate to the control valve system 200 when the debris catcher 40 and/or the sand separator 50 is full or is otherwise in a condition in which a blow out of the debris or sand is required. The sensor 270 can also be used to detect when the debris or sand from the debris catcher 40 and/or the sand separator 50 has been completely removed and/or when a desired or pre-determined amount of debris or sand has been blown out. The sensor 270 may also be used to communicate to the control valve system 200 when the debris or sand has been completely removed and/or when a desired or pre-determined amount of debris or sand has been blown out.

Figure 3:
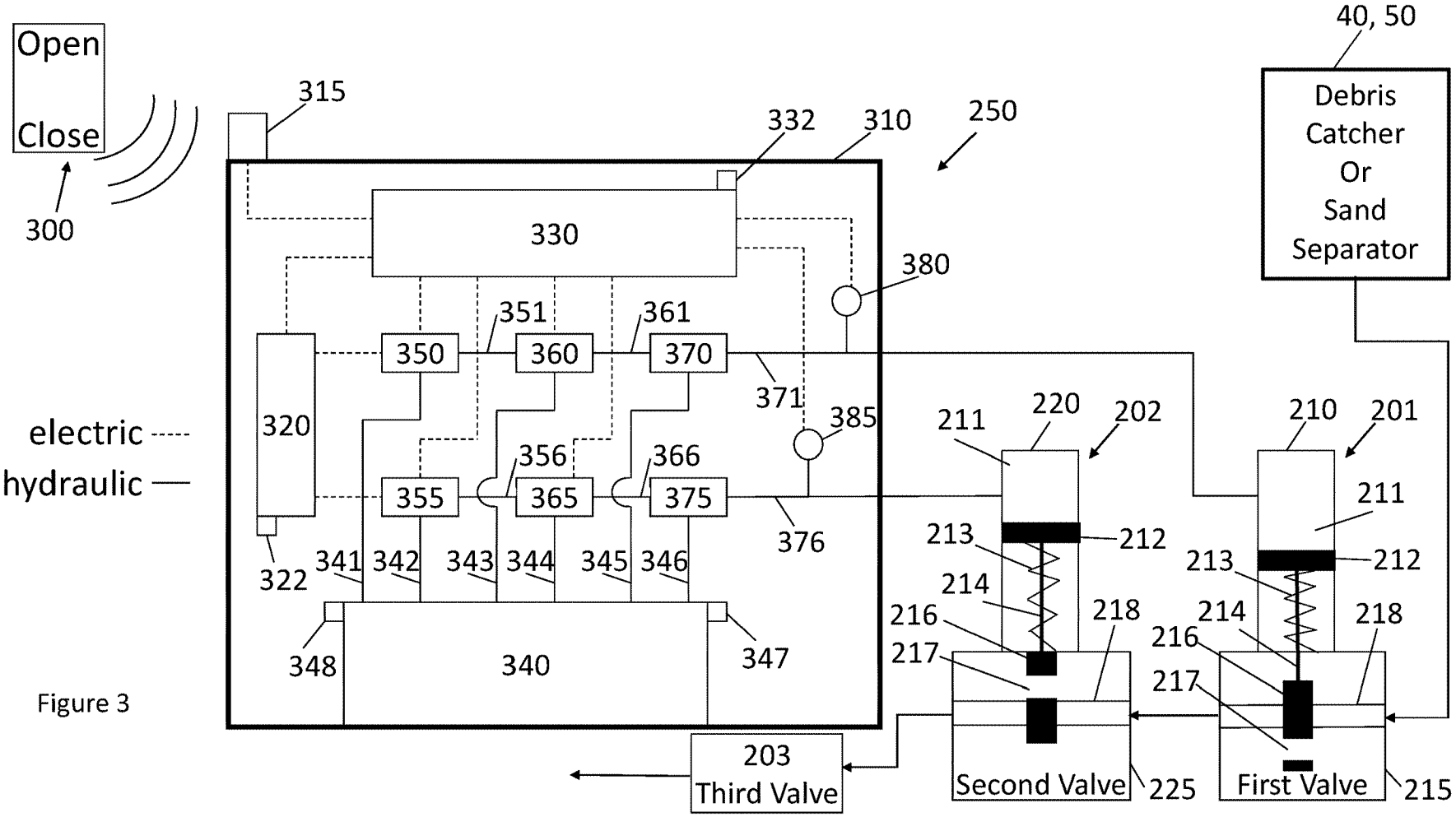
FIG. 3 illustrates an actuator control system according to one embodiment.

FIG. 3 illustrates the actuator control system 250 in communication with the first and second valve assemblies 201, 202. The first and second valve actuators 210, 220 each include a pressure chamber 211 disposed above a piston 212, which is coupled to a gate valve 216 by a piston rod 214. Each gate valve 216 includes an opening 217 to allow fluid to flow through the first and second valves 215, 225 when the opening 217 is aligned with fluid paths 218 disposed through the first and second valves 215, 225. A biasing member 213 biases the piston 212 in a direction away from the first and second valves 215, 225 to move the gate valves 216 between the open and closed positions.

As shown in FIG. 3, the first valve 215 is in the closed position. Pressurized fluid is supplied from the actuator control system 250 to the pressure chamber 211 of the first valve actuator 210, which applies a force to the piston 212 that is greater than the bias force of the biasing member 213. The piston 212 moves in a direction toward the first valve 215, which compresses the biasing member 213 and moves the gate valve 216 via the piston rod 214 into a closed positon. Specifically, the opening 217 of the gate valve 216 is moved out of alignment with the fluid path 218 disposed through the first valve 215 to prevent fluid flow through the first valve 215. Upon release of the pressurized fluid in the pressure chamber 211 of the first valve actuator 210, the biasing member 213 forces the piston 212 in a direction away from the first valve 215, which moves the gate valve 216 via the piston rod 214 into the open position. Specifically, the opening 217 of the gate valve 216 is moved into alignment with the fluid path 218 disposed through the first valve 215 to allow fluid flow through the first valve 215. The first valve assembly 201 is a fail open valve such that in the event of an emergency the pressurized fluid is removed from the first valve actuator 210 to allow the biasing member 213 to move the gate valve 216 into the open position.

As further shown in FIG. 3, the second valve 225 is in the closed position. Pressurized fluid may be removed from the pressure chamber 211 of the second valve actuator 220 and returned to the actuator control system 250 such that the bias force of the biasing member 213 on the piston 212 is greater than any force on the piston 212 applied by the pressurized fluid (if any) in the pressure chamber 211. The piston 212 moves in a direction away from the second valve 225, which moves the gate valve 216 via the piston rod 214 into a closed positon. Specifically, the opening 217 of the gate valve 216 is moved out of alignment with the fluid path 218 disposed through the second valve 225 to prevent fluid flow through the second valve 225. Pressurized fluid may be supplied from the actuator control system 250 to the pressure chamber 211 of the second valve actuator 220, which applies a force to the piston 212 that is greater than the bias force of the biasing member 213. The piston 212 moves in a direction toward the second valve 225, which compresses the biasing member 213 and moves the gate valve 216 via the piston rod 214 into the closed positon. Specifically, the opening 217 of the gate valve 216 is moved into alignment with the fluid path 218 disposed through the second valve 225 to allow fluid flow through the second valve 225. The second valve assembly 202 is a fail closed valve such that in the event of an emergency the pressurized fluid is removed from the second valve actuator 220 to allow the biasing member 213 to move the gate valve 216 into the closed position.

The actuator control system 250 is configured to supply pressurized fluid to the first valve actuator 210 and the second valve actuator 220 to selectively actuate the first and second valves 215, 225. The actuator control system 250 may be operated by wired and/or wireless communication via a control device 300 to actuate the first and second valve actuators 210, 220 to open and close the first and second valves 215, 225.

In one embodiment, the control device 300 may be a remote control device that is located at a location remote from the actuator control system 250. In one embodiment, the control device 300 may be a local control device that is located near the actuator control system 250. In one embodiment, the control device 300 may include a touch-screen for monitoring and controlling the operation of the actuator control system 250. In one embodiment, the control device 300 may display the status of the first and second valve assemblies 201, 202 using one or more color indicators, such as green for open, yellow for neutral, and red for closed, may be enabled with a one-push button control to open and close the first and second valve assemblies 201, 202, and may also display one or more measured characteristics, such as the opening and closing pressure and force of the first and second valve actuators 210, 220.

The actuator control system 250 may be "self-contained," which means that it does not depend on any external pneumatic, hydraulic, mechanical, or electrical sources for its operation to actuate the first and second valve actuators 210, 220 with limited exception depending on various embodiments. One exception including a signal sent to a controller assembly 330 via the control device 300 and a receiver 315. Another exception including solar energy provided by the sun to re-charge and/or power a power source 320. In general, all of the operating fluids and mechanisms necessary to actuate the first and second valve actuators 210, 220 are maintained within the actuator control system 250 to effectively open and close the first and second valve assemblies 201, 202 with minimal, if any, additional external dependency.

The actuator control system 250 may include a housing 310, a receiver 315, a power source 320, a controller assembly 330, a fluid reservoir 340, a first and second pump assembly 350, 355, a first and second control valve assembly 360, 365, and a first and second relief valve assembly 370, 375. The actuator control system 250 may include a first and second transducer 380, 385. Numerous hydraulic and electric lines may provide communication between one or more components of the actuator control system 250 as described herein.

The housing 310 may include any structural support member, such as an explosion proof container, for protecting and supporting the components stored therein from damage and environmental elements. Appropriate ventilation of the housing 310 may be provided by ventilation holes and/or an independent solar powered fan mounted in or through the housing 310. The housing 310 may further include an access panel or door for ease of access to the housing's interior, and may be configured for attachment to any type of support structure, including either of the first and second valve actuators 210, 220 and/or the first and second valves 215, 225. One or more manifold assembles may be provided on the housing 310 for fluid and/or electrical connection between the housing 310 (and the components within the housing 310) and the first and second valve actuators 210, 220, the first and second valves 215, 225, the receiver 315, and/or any other components external to the housing 310. The structural components of the actuator control system 250, to the extent possible, may be made from stainless steel.

The power source 320 may provide power to the receiver 315, the controller assembly 330, and/or the first and second pump assemblies 350, 355. The power source 320 may be operable to provide a low current (amp) stream to these various components. The power source 320 may include an intrinsically-safe battery, such as a 12 or 24 volt, direct current, explosion proof power supply. The power source 320 may include a watchdog sensor 322 to communicate to an operator at a remote location via the controller assembly 330 a failure of the power source 320. The watchdog sensor 322 may also give an auditory or visual alarm to alert an operator onsite that the power source 320 is low and/or dead. The controller assembly 330 may be configured to automatically open and/or close the first and second valve assemblies 201, 202 upon receiving a signal from the watchdog sensor 322. The power source 320 may be a (re-chargeable) power supply that is supported by a solar panel assembly. The solar panel assembly may include one or more solar panels connected to the exterior of the housing 310 to consume light energy from the sun to generate electricity. An intrinsically safe voltage controller may deliver electrical current at an appropriate voltage, 12 or 24 volts for example, to the power source 320, which in turn supplies power to the components of the actuator control system 250. The controller assembly 330 may be weather-proof, and may be intrinsically safe to provide power as necessary to one or more components of the actuator control system 250.

The controller assembly 330 may include a programmable micro-processing unit having a display screen and a keypad operable to communicate with and control the actuator control system 250 components to actuate the first and second valve actuators 210, 220 as described herein. For example, the controller assembly 330 may include a programmable logic controller, including a supervisory control and data acquisition system (SCADA) that is in communication with the receiver 315, the power source 320, the first and second pump assemblies 350, 355, the first and second control valve assemblies 360, 365, and/or the first and second transducers 380, 385. A current regulator may be used to provide low current transmission between the controller assembly 330 and the various components of the actuator control system 250. A watchdog sensor 332 may be used to monitor the operation of the controller assembly 330 and provide an alarm in the event of a failure.

The controller assembly 330 may be operable to send and/or receive signals directly with the control device 300 and/or with the use of the receiver 315. The control device 300 may include a one-way or two-way control, and/or a computer system (such as a desktop computer, laptop computer, or personal digital assistant), which can be used at a location remote from or local to the actuator control system 250. Signals may be sent and/or received between the controller assembly 330, the receiver 315, and/or the control device 300 via wired and/or wireless telemetry means, including but not limited to electrical wires, fiber optical cables, radio frequency, infrared, microwave, and/or laser light communication. Signals may be sent and/or received between the control device 300 and the sensor 270 directly or via the controller assembly 330 regarding the operational condition of the debris catcher 40 and/or the sand separator 50. In this manner, the actuator control system 250 can be monitored and operated locally and/or remotely from one or more locations on-site or off-site relative to the actuator control system 250.

The actuator control system 250 may be configured for manual and/or remote operation on-site at the location of the first and second valve actuators 210, 220 and the first and second valves 215, 225. Manual operation may include a hand pump assembly to pump fluid from the fluid reservoir 340 to the first and second valve actuators 210, 220, and/or a manual override assembly to actuate the first and second valve actuators 210, 220 thereby opening and closing the first and second valves 215, 225. The control device 300 may be wired directly to the actuator control system 250, and may be coupled to an exterior of or disposed within the housing 310 (or another structure/enclosure adjacent the actuator control system 250) for access to on-site remote operation.

The fluid reservoir 340 may be configured to store an amount of operating fluid sufficient to actuate the first and second valve actuators 210, 220. Although only one fluid reservoir 340 is shown, the control system 250 may include two separate fluid reservoirs 340 dedicated to actuating the first and second valve actuators 210, 220. The operating fluid may include air, water, propylene glycol, and other valve operating fluids known in the art.

The fluid reservoir 340 may include a level gauge 347, such as a sight glass, to indicate the level of fluid in the fluid reservoir 340. The fluid reservoir 340 may also include a level sensor 348 that is in communication with the controller assembly 330 and is operable to monitor in real-time the level of fluid in the fluid reservoir 340. In the event that the level of fluid falls below a pre-set limit, due to a small leak of the fluid for example, the level sensor 348 may provide an alarm to alert an operator on-site near the actuator control system 250 and/or at the remote location via the controller assembly 330 and the control device 300. The controller assembly 330 may automatically open or close the first and second valve assemblies 201, 202 upon receiving a signal from the level sensor 348.

The first and second pump assemblies 350, 355 may include an intrinsically safe and/or explosion proof motor and a pump. The first and second pump assemblies 350, 355 may include positive displacement/rotary piston pumps with about a 100 to 10,000 psi range. The first and second pump assemblies 350, 355 may be rated for about 200 psi to about 300 psi. One or more of the components of the actuator control system 250 may be rated for up to about 2500 psi. The first and second pump assemblies 350, 355 may be configured to pump hydraulic and/or pneumatic fluid from the fluid reservoir 340 to the first and second valve actuators 210, 220 to actuate the first and second valves 215, 225. Although two pump assemblies are shown, a single reversible pump assembly may be used to pump fluid to the first and second valve actuators 210, 220.

The first and second control valve assemblies 360, 365 may include one or more intrinsically safe solenoid valves operable to control and direct communication between the first and second pump assemblies 350, 355, respectively, the fluid reservoir 340, and the first and second valve actuators 210, 220. The first and second control valve assemblies 360, 365 may be operable to open and close the fluid circuits between the first and second pump assemblies 350, 355, respectively, the fluid reservoir 340, and the first and second valve actuators 210, 220. The controller assembly 330 may be used to control operation (e.g. open and close) of the first and second control valve assemblies 360, 365 to thereby control actuation of the first and second valve actuators 210, 220.

The first and second relief valve assemblies 370, 375 may include one or more pressure controlled shuttle valves operable to control and direct communication between the first and second pump assemblies 350, 355, respectively, the fluid reservoir 340, and the first and second valve actuators 210, 220. The first and second relief valve assemblies 370, 375 may be operable to open and close the fluid circuits between the first and second pump assemblies 350, 355, respectively, the fluid reservoir 340, and the first and second valve actuators 210, 220 to rapidly expel fluid from the first and second valve actuators 210, 220 to the fluid reservoir 340 to ensure rapid open and or closure of the first and second valves 215, 225. A pressure change in a fluid circuit that is in communication with the first and second relief valve assemblies 370, 375 may actuate the valve assemblies to open and/or close another fluid circuit, thereby allowing fluid pressure to flow into the first and second valve actuators 210, 220 and/or allowing quick relief of fluid pressure to flow out of the first and second valve actuators 210, 220.

The first and second transducers 380, 385 may include pressure sensors operable sense the pressure in the fluid circuits of the actuator control system 250. The pressure sensors may be configured to start and/or stop the first and second pump assemblies 350, 355, respectively, when the pressure in the fluid circuits and/or the first and second valve actuators 210, 220 reaches a pre-determined and/or pre-set pressure. The pressure sensors may be in communication with the first and second pump assemblies 350, 355 directly and/or via the controller assembly 330. The first and second transducers 380, 385 may include one or more gauges that can be visually inspected to monitor the pressure in the fluid circuits of the actuator control system 250.

In one embodiment, the first control valve assembly 360 and the first relief valve assembly 370 may be integrated into a single manifold system that is in communication with the first pump assembly 350 and the pressure chamber 211 of the first valve actuator 210. The integrated manifold system may have a single exhaust fluid circuit to return fluid from the pressure chamber 211 to the fluid reservoir 340. The second control and relief valve assemblies 365 and 375 may be similarly combined with the second pump assembly 355 and the pressure chamber 211 of the second valve actuator 220.

The actuator control system 250 is operable to direct pressurized fluid from the fluid reservoir 340 to the pressure chamber 211 of the first valve actuator 210 upon receiving a signal from the control device 300, thereby closing the first valve 215. The actuator control system 250 is operable to direct pressurized fluid from the fluid reservoir 340 to the pressure chamber 211 of the second valve actuator 220 upon receiving a signal from the control device 300, thereby opening the second valve 225.

Pressurization of the pressure chamber 211 of the first valve actuator 210 via a first fluid circuit comprising conduits 341, 351, 361, and 371 that is in communication with the fluid reservoir 340 may actuate the first valve actuator 210 to close the first valve 215. Pressurized fluid in the pressure chamber 211 may be discharged into the fluid reservoir 340 via a quick relief circuit comprising conduit 345 that is in communication with the first fluid circuit. Pressurized fluid in the first fluid circuit may also be discharged into the fluid reservoir 340 via an exhaust circuit comprising conduit 343 that is in communication with the first fluid circuit. The first pump assembly 350, the first control valve assembly 360, the first relief valve assembly 370, and the first transducer 380 are in communication with the first fluid circuit to deliver and relieve pressurized fluid to and from the pressure chamber 211 of the first valve actuator 210.

Pressurization of the pressure chamber 211 of the second valve actuator 220 via a second fluid circuit comprising conduits 342, 356, 366, and 376 that is in communication with the fluid reservoir 340 may actuate the second valve actuator 220 to open the second valve 225. Pressurized fluid in the pressure chamber 211 of the second valve actuator 220 may be discharged into the fluid reservoir 340 via a quick relief circuit comprising conduit 346 that is in communication with the second fluid circuit. Pressurized fluid in the second fluid circuit may also be discharged into the fluid reservoir 340 via an exhaust circuit comprising conduit 344 that is in communication with the second fluid circuit. The second pump assembly 355, the second control valve assembly 365, the second relief valve assembly 375, and the second transducer 385 are in communication with the second fluid circuit to deliver and relieve pressurized fluid to and from the pressure chamber 211 of the second valve actuator 220.

Figure 4:
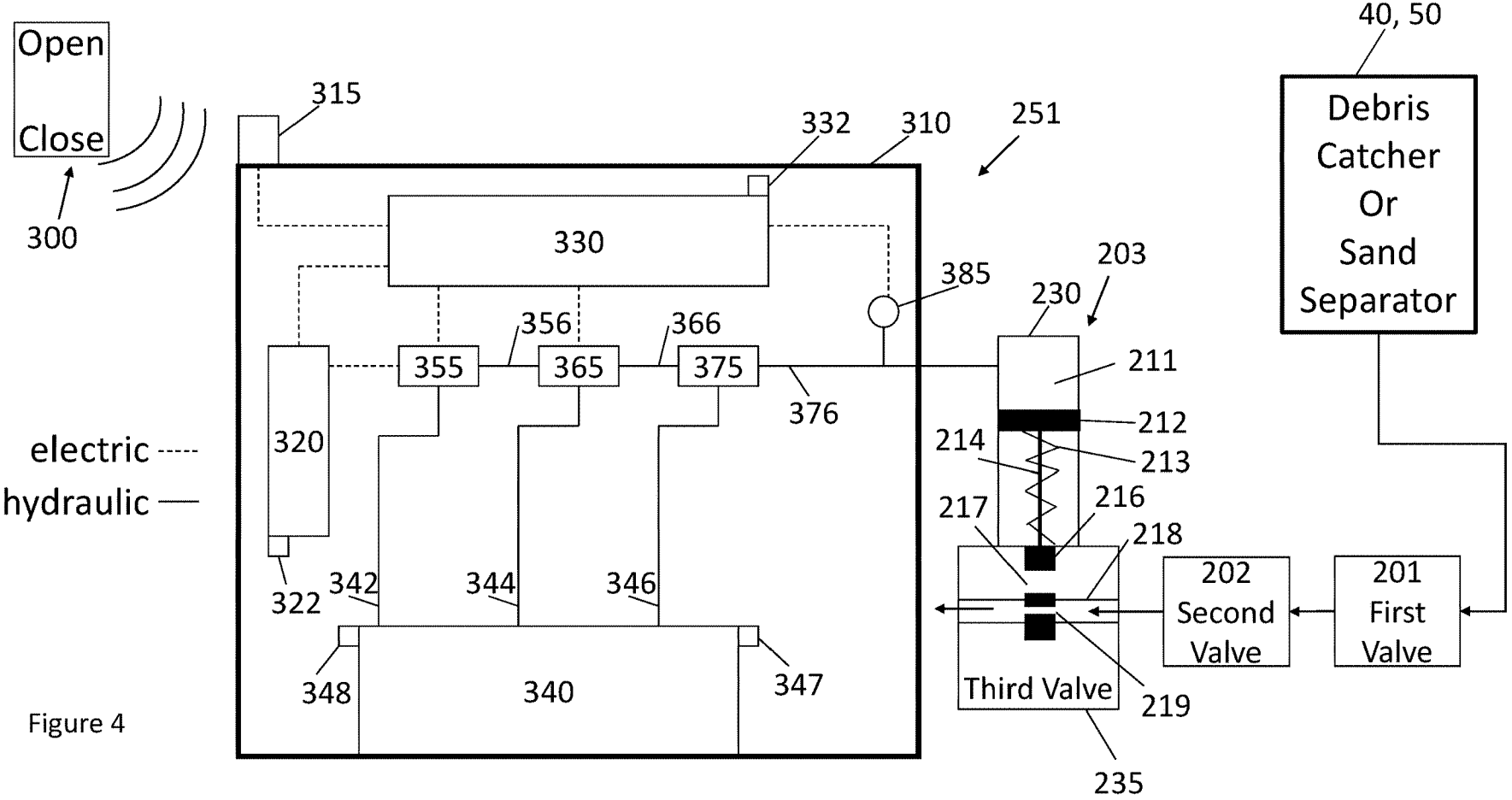
FIG. 4 illustrates an actuator control system according to one embodiment.

FIG. 4 illustrates the actuator control system 251 in communication with the third valve assembly 203. The third valve actuator 230 includes a pressure chamber 211 disposed above a piston 212, which is coupled to a gate valve 216 by a piston rod 214. The gate valve 216 includes an opening 217 to allow fluid to flow through the third valve 235 when the opening 217 is aligned with fluid paths 218 disposed through the third valve 235. A biasing member 213 biases the piston 212 in a direction away from the third valve 235 to move the gate valve 216 between the open and closed positions.

One difference between the third valve assembly 203 and the first and second valve assemblies 201, 202 is that the gate valve 216 of the third valve assembly 203 has a choke port 219. When the third valve 235 is in the closed position, the choke port 219 is aligned with the fluid path 218 to allow fluid flow through the third valve 235. The diameter of the choke port 219 is less than the diameter of the opening 217 of the gate valve 216 and less than the diameter of the fluid path 218 disposed through the third valve 235. The diameter of the choke port 219 is determined by the type and/or size of debris or sand that needs to be blown out from the debris catcher 40 and/or the sand separator 50.

As shown in FIG. 4, the third valve 235 is in the closed position such that the choke port 219 of the gate valve 216 is aligned with the fluid paths 218 of the third valve 235. Pressurized fluid may be removed from the pressure chamber 211 of the third valve actuator 220 and returned to the actuator control system 251 such that the bias force of the biasing member 213 on the piston 212 is greater than any force on the piston 212 applied by the pressurized fluid (if any) in the pressure chamber 211. The piston 212 moves in a direction away from the third valve 235, which moves the gate valve 216 via the piston rod 214 into a closed positon. Specifically, the opening 217 of the gate valve 216 is moved out of alignment with the fluid path 218 disposed through the third valve 235 to prevent full bore fluid flow through the third valve 235 and only allow fluid flow through the choke port 219. Pressurized fluid may be supplied from the actuator control system 251 to the pressure chamber 211 of the third valve actuator 230, which applies a force to the piston 212 that is greater than the bias force of the biasing member 213. The piston 212 moves in a direction toward the third valve 235, which compresses the biasing member 213 and moves the gate valve 216 via the piston rod 214 into the closed positon. Specifically, the opening 217 of the gate valve 216 is moved into alignment with the fluid path 218 disposed through the third valve 225 to allow fluid bore fluid flow through the third valve 225. The third valve assembly 203 is a fail closed valve such that in the event of an emergency the pressurized fluid is removed from the third valve actuator 230 to allow the biasing member 213 to move the gate valve 216 into the closed position.

The actuator control system 251 is configured to supply pressurized fluid to the third valve actuator 230 to selectively actuate the third valve 235. The actuator control system 251 may be operated by wired and/or wireless communication via a control device 300 to actuate the third valve actuator 230 to open and close the third valve 235. The control device 300 of the actuator control system 251 may be the same as the control device 300 of the actuator control system 250, therefore a full description of all the components and operation of the control device will not be repeated herein for brevity.

The actuator control system 251 may contain the same components and operate in a similar manner as the actuator control system 250, therefore a full description of all the components and operation of the actuator control system 251 will not be repeated herein for brevity. One difference between the actuator control systems 250, 251 is that the actuator control system 251 as shown in FIG. 4 does not include the second pump assembly 355, the second control valve assembly 365, the second relief valve assembly 375, the second transducer 385, and the corresponding hydraulic and electric lines.

Figure 5:
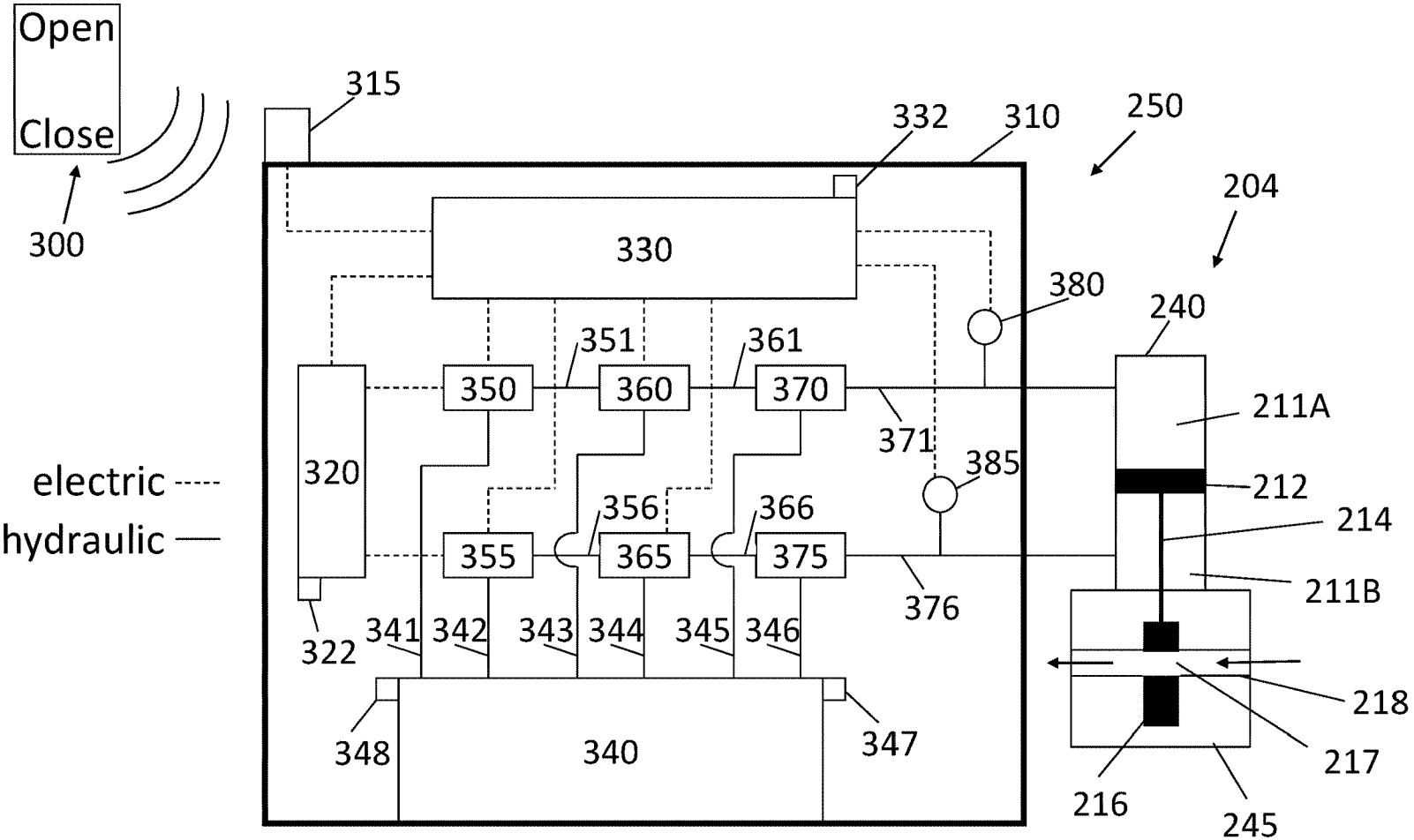
FIG. 5 illustrates an actuator control system according to one embodiment.

FIG. 5 illustrates the valve actuator control system 250 in communication with a double acting valve assembly 204 having a double acting valve actuator 240 coupled to a valve 245. The double acting valve assembly 204 may be used in place of any one or more of the first, second, and/or third valve assemblies 201, 202, 203. Each double acting valve assembly 204 can have a separate valve actuator control system 250. Alternatively, a single valve actuator control system 250 can be used to actuate at least two or all three of the valve assemblies 201, 202, 203, such as by include third, fourth, fifth, and/or sixth sets of pump assemblies, control valve assemblies, relief valve assemblies, and/or transducers (and corresponding hydraulic and electric lines) similar to the first pump assembly 350, the first control valve assembly 360, the first relief valve assembly 370, the first transducer 380, and the corresponding hydraulic and electric lines.

The double acting valve actuator 240 has a first pressure chamber 211A, a second pressure chamber 211B, and a piston 212 disposed between the first and second pressure chambers 211A, 211B that is coupled to a gate valve 216 via a piston rod 214. The gate valve 216 may include a choke port similar to the choke port 219 as shown in FIG. 4. Pressurized fluid supplied from the valve actuator control system 250 to the first pressure chamber 211A moves the piston 212 in a direction toward the valve 245 to open or close fluid flow through a fluid path 218 of the valve 245 depending on where an opening 217 of the gate valve 216 is located. Pressurized fluid supplied from the valve actuator control system 250 to the second pressure chamber 211B moves the piston 212 in an opposite direction away from the valve 245 to open or close fluid flow through the fluid path 218 of the valve 245 depending on where the opening 217 of the gate 216 is located. The opening 217 of the gate valve 216 will be determined by which one or more of the first, second, and/or third valve assemblies 201, 202, 203 are being replaced by the double acting valve assembly 204. In one embodiment, in the event of a failure, the valve actuator 210 may be configured to "fail-as-is," fail in a closed position, or fail in an open position. Other types of valve actuators and valves known in the art may be used with the embodiments described herein.

Figure 6:
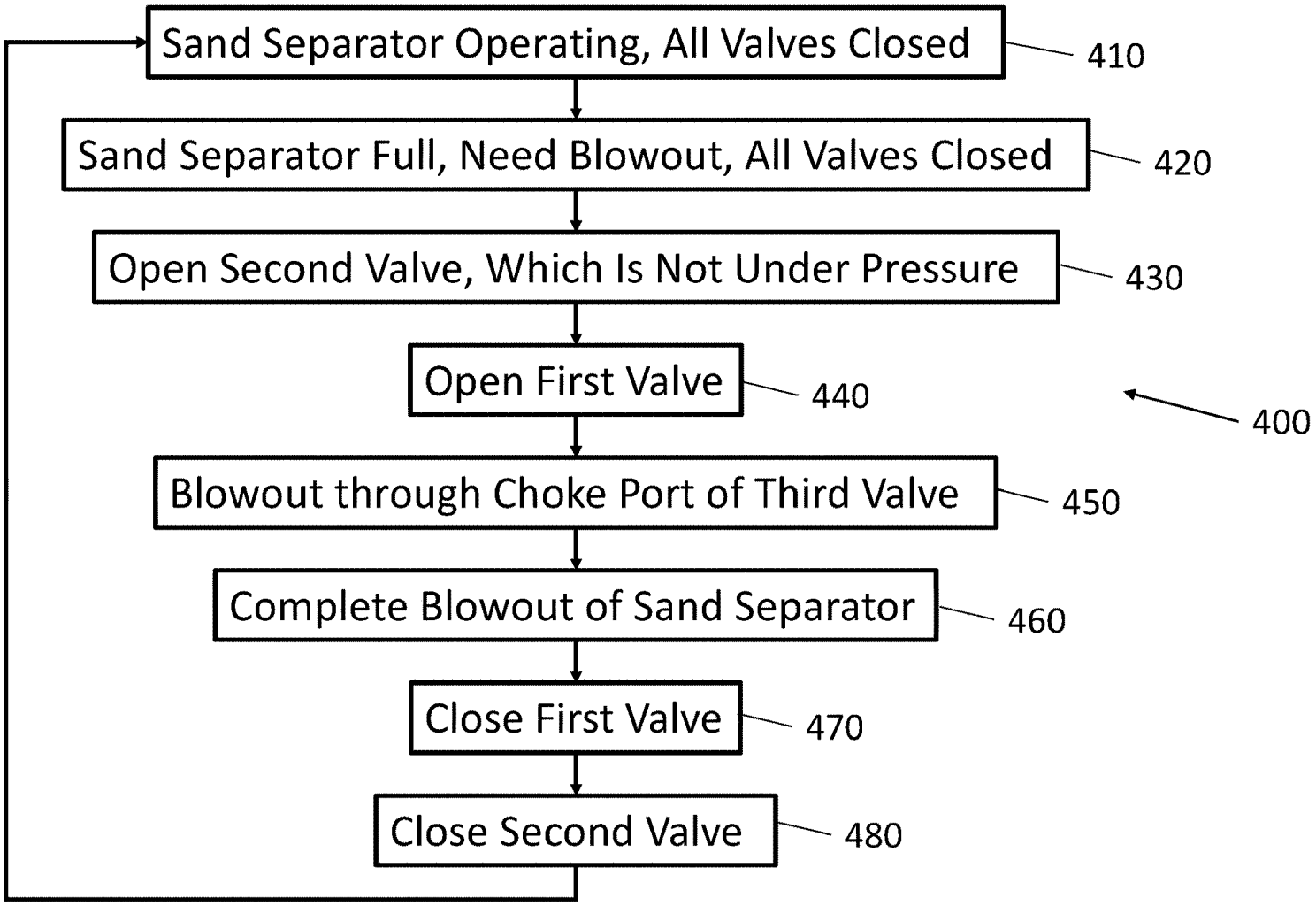
FIG. 6 illustrates a method of blowing out sand from a sand separation device according to one embodiment.

FIG. 6 illustrates a method 400 of blowing out sand from a sand separation device, such as the sand separator 50, using the control valve system 200 illustrated in FIGS. 2, 3, and 4. The method 400 illustrates only one embodiment and may include more or less steps, all of which can be performed in a different order and/or any of which can be repeated. The method 400 may similarly apply to blowing out debris from the debris catcher 40.

At step 410, the sand separator 50 is operating as normal, removing sand from a fluid stream flowing from the wellhead 20, through the frac tree 10, the high integrity pressure protection system 30, and the debris catcher 40. After sand has been removed, the fluid stream may flow to the choke manifold 60 and other equipment for further processing, storage, and/or transport. The first, second, and third valve assemblies 201, 202, 203 of the control valve system 200 are in the closed position.

At step 420, the sand separator 50 is full or is otherwise in a condition in which a blow out of the sand from the sand separator 50 is required. The first, second, and third valve assemblies 201, 202, 203 of the control valve system 200 are in the closed position. The sensor 270 can be used to detect when the sand separator 50 is full or is otherwise in a condition in which a blow out of the sand from the sand separator 50 is required. The sensor 270 may also be used to communicate to the control device 300 and/or the control valve system 200 when the sand separator 50 is full or is otherwise in a condition in which a blow out of the sand from the sand separator 50 is required.

At step 430, the second valve assembly 202 is moved to the open position, which is not under pressure since the first valve assembly 201 is closed. Since the first valve assembly 201 is closed when the second valve assembly 202 is being opened, there is no pressure in the fluid path 218 of the second valve 225 that would otherwise cause additional force on the gate valve 216 when moving from the closed position to the open position. The second valve assembly 202 is not exposed to pressurized fluid from the debris catcher 40 or the sand separator 50 when moving from the closed position to the open position. Being able to actuate the second valve 225 while not under pressure increases the lifespan of the second valve assembly 202.

To open the second valve assembly 202, an operator may transmit a signal from the control device 300 to the actuator control system 250 to actuate the second valve actuator 220 to open the second valve 225. The signal may be received by the receiver 315 and communicated to the controller assembly 330, and/or may be directly received by the controller assembly 330. Upon receiving the signal, the controller assembly 330 may actuate the second valve 225 by supplying pressurized fluid to the second valve actuator 220. The controller assembly 330 may actuate the second pump assembly 355 and/or the second control valve assembly 365 to direct pressurized fluid from the fluid reservoir 340 to the pressure chamber 211 of the second valve actuator 220 via conduits 342, 344, 356, 366, 376. The pressurized fluid applies a force to the piston 212 that is greater than the bias force of the biasing member 213, which moves the gate valve 216 via the piston rod 214 from the closed position to the open position such that the opening 217 is in alignment with the fluid path 218 of the second valve 225. The controller assembly 330 may also activate the second transducer 385 to monitor the pressure in the conduit 376 and thus in the pressure chamber 211. When the pressure in the pressure chamber 211 reaches a pre-determined pressure, the second transducer 385 is operable to turn off the second pump assembly 355, directly and/or via the controller assembly 330. The second control valve assembly 365 maintains pressure in the conduit 366, which closes the second relief valve assembly 375. The second relief valve assembly 375 maintains pressure in the conduit 376 and thus in the pressure chamber 211, thereby maintaining the second valve 225 in the open position. The second transducer 385 is operable to continuously monitor the pressure in the conduit 376 and thus in the pressure chamber 211. In the event that the pressure in the pressure chamber 211 falls below a pre-determined pressure setting (e.g. due to a loss of fluid) the second transducer 385 may actuate the second pump assembly 355 to provide additional pressurized fluid from the fluid reservoir 340 to the pressure chamber 211 to maintain the pressure in the second valve actuator 220 at or above the pre-determined pressure setting.

At step 440, the first valve assembly 201 is moved to the open position. Specifically, pressurized fluid supplied by the actuator control system 250 to the first valve actuator 210 which maintains the first valve 215 in the closed position must be relieved to allow the first valve 215 to be moved to the open position. To open the first valve assembly 201, the operator may transmit a signal via the control device 300 to the actuator control system 250 to actuate the first control valve assembly 360 to relieve the pressure in the conduits 371 and 361 via the exhaust circuit, i.e. conduit 343, to the fluid reservoir 340. The pressure drop in the conduit 361 will then actuate the first relief valve assembly 370 to quickly relieve the fluid pressure in the conduit 371 and in the pressure chamber 211 of the first valve actuator 210 via the quick relief circuit, i.e. conduit 345. As the pressurized fluid is removed from the pressure chamber 211 of the first valve actuator 210, the force of the biasing member 213 moves the piston 212 in a direction away from the first valve 215, which moves the gate valve 216 via the piston rod 214 into the open positon such that the opening 217 of the gate 216 is in alignment with the fluid path 218 disposed through the first valve 215.

At step 450, sand from the sand separator 50 may flow through the first valve 215, through the second valve 225, and through the choke port 219 of the gate valve 216 of the third valve 235. The third valve 235 is maintained in the closed position by the biasing member 213, and as stated above, when the third valve 235 is in the closed position, the choke port 219 is in alignment with the fluid path 218 disposed through the third valve 235. If at any point it is desired to have full bore flow through the third valve assembly 203, the third valve 235 can be moved to the open position by pressurized fluid supplied from the control valve system 251 to the pressure chamber 211 of the third valve actuator 230 in a similar manner as the opening of the second valve assembly 201.

At step 460, the blowout of the sand from the sand separator 50 is continued until complete. The sensor 270 can be used to detect when the sand from the sand separator 50 has been completely removed and/or when a desired or pre-determined amount of sand has been blown out from the sand separator 50. The sensor 270 may also be used to communicate to the control device 300 and/or the control valve system 200 when the sand from the sand separator 50 has been completely removed and/or when a desired or pre-determined amount of sand has been blown out from the sand separator 50.

At step 470, the first valve assembly 201 is moved to the closed position. To close the first valve assembly 201, an operator may transmit a signal from the control device 300 to the actuator control system 250 to actuate the first valve actuator 210 to open the first valve 215. The signal may be received by the receiver 315 and communicated to the controller assembly 330, and/or may be directly received by the controller assembly 330. Upon receiving the signal, the controller assembly 330 actuates the first valve 215 by supplying pressurized fluid to the first valve actuator 210. The controller assembly 330 may actuate the first pump assembly 350 and/or the first control valve assembly 360 to direct pressurized fluid from the fluid reservoir 340 to the pressure chamber 211 of the first valve actuator 210 via conduits 341, 343, 351, 361, 371. The pressurized fluid applies a force to the piston 212 that is greater than the bias force of the biasing member 213, which compresses the biasing member 213 and moves the gate valve 216 via the piston rod 214 from the open position to the close position such that the opening 217 is out of alignment with the fluid path 218 of the first valve 215 to prevent fluid flow through the first valve 215. The controller assembly 330 may also activate the first transducer 380 to monitor the pressure in the conduit 371 and thus in the pressure chamber 211. When the pressure in the pressure chamber 211 reaches a pre-determined pressure, the first transducer 380 is operable to turn off the first pump assembly 350, directly and/or via the controller assembly 330. The first control valve assembly 360 maintains pressure in the conduit 361, which closes the first relief valve assembly 370. The first relief valve assembly 370 maintains pressure in the conduit 371 and thus in the pressure chamber 211, thereby maintaining the first valve 215 in the closed position. The first transducer 380 is operable to continuously monitor the pressure in the conduit 371 and thus in the pressure chamber 211. In the event that the pressure in the pressure chamber 211 falls below a pre-determined pressure setting (e.g. due to a loss of fluid) the first transducer 380 may actuate the first pump assembly 350 to provide additional pressurized fluid from the fluid reservoir 340 to the pressure chamber 211 to maintain the pressure in the first valve actuator 210 at or above the pre-determined pressure setting.

At step 480, the second valve assembly 202 is moved to the closed position, which is not under pressure since the first valve assembly 201 is now closed. Since the first valve assembly 201 is closed when the second valve assembly 202 is being closed, there is no pressure in the fluid path 218 of the second valve 225 that would otherwise cause additional force on the gate valve 216 when moving from the open position to the closed position. The second valve assembly 202 is not exposed to pressurized fluid from the debris catcher 40 or the sand separator 50 when moving from the open position to the closed position. Being able to actuate the second valve 225 while not under pressure increases the lifespan of the second valve assembly 202.

Specifically, pressurized fluid supplied by the actuator control system 250 to the second valve actuator 220 which maintains the second valve 215 in the open position must be relieved to allow the second valve 215 to be moved to the closed position. To close the second valve assembly 202, the operator may transmit a signal via the control device 300 to the actuator control system 250 to actuate the second control valve assembly 365 to relieve the pressure in the conduits 376 and 366 via the exhaust circuit, i.e. conduit 346, to the fluid reservoir 340. The pressure drop in the conduit 366 will then actuate the second relief valve assembly 375 to quickly relieve the fluid pressure in the conduit 376 and in the pressure chamber 211 of the second valve actuator 220 via the quick relief circuit, i.e. conduit 346. As the pressurized fluid is removed from the pressure chamber 211 of the second valve actuator 220, the force of the biasing member 213 moves the piston 212 in a direction away from the second valve 215, which moves the gate valve 216 via the piston rod 214 into the closed positon such that the opening 217 of the gate 216 is out of alignment with the fluid path 218 disposed through the second valve 225 to prevent fluid flow through the second valve 225.

The first, second, and third valve assemblies 201, 202, 203 are all closed and the operation of the sand separator 50 may continue operation. The method 400 can be repeated as necessary to blow out sand from the sand separator 50. The same method of operation may be used to blow out debris from the debris catcher 40.

Figure 7:
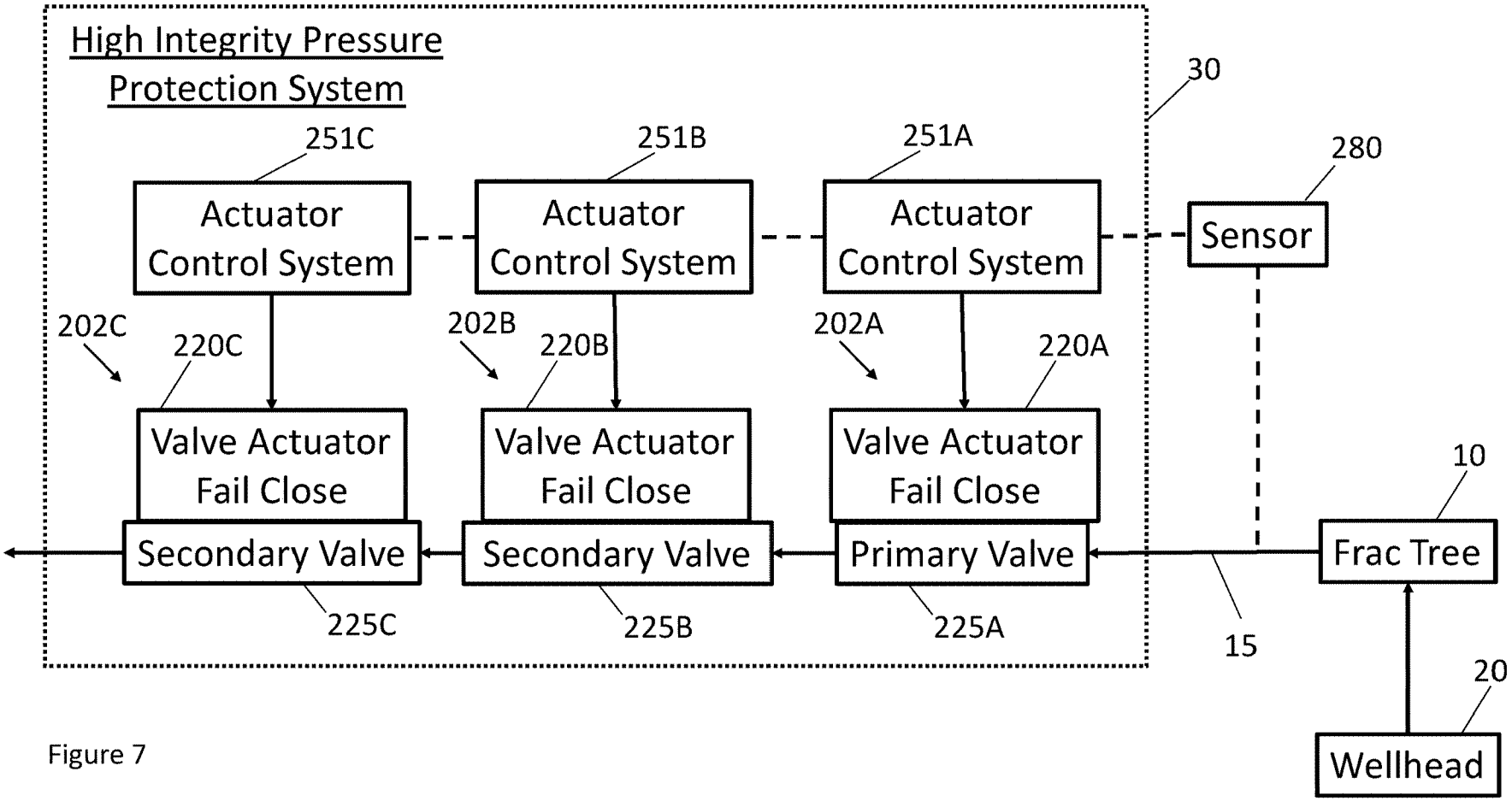
FIG. 7 illustrates a high integrity pressure protection system according to one embodiment.

FIG. 7 illustrates a high integrity pressure protection system 30. The protection system 30 includes several of the components of the control valve system 200 discussed above with respect to FIGS. 1-6. The protection system 30 may be located at any position downstream of the frac tree 10 and is configured to shut off fluid flow to any equipment located downstream of the protection system 30 in the event of an emergency, such as an over pressurization detected within the fluid lines providing fluid communication between the frac tree 10 and any equipment located downstream of the frac tree 10.

The protection system 30 includes three valve assemblies 202A, 202B, 202C that are in fluid communication with each other and connected together in series. The valve assemblies 202A, 202B, 202C are each similar in components and operation to at least the second valve assembly 202 described and illustrated with respect to at least FIG. 3. Each of the valve assemblies 202A, 202B, 202C are configured as fail close safety valves such that in an event of a failure the valve will automatically move to the closed position if not already in the closed position to prevent fluid flow through the protection system 30.

The valve assembly 202A includes a valve actuator 220A that is coupled to and configured to actuate a primary valve 225A between an open position and a closed positon to allow and prevent fluid from flowing through the primary valve 225A. The valve assembly 202B includes a valve actuator 220B that is coupled to and configured to actuate a secondary valve 225B between an open position and a closed positon to allow and prevent fluid from flowing through the secondary valve 225B. The valve assembly 202C includes a valve actuator 220C that is coupled to and configured to actuate another secondary valve 225C between an open position and a closed positon to allow and prevent fluid from flowing through the secondary valve 225C. The secondary valves 225B, 225C are used as backup safety valves in the event of a failure of the primary valve 225A. The protection system 30 may include one or more backup safety valves.

Each of the valve actuators 220A, 220B, 220C are operable by a respective actuator control system 251A, 251B, 251C, which are similar in components and operation to the actuator control system 251 described and illustrated with respect to at least FIG. 4. Each actuator control system 251A, 251B, 251C may be in communication with each over via a control device 300 and/or a controller assembly 330 as described and illustrated with respect to at least FIGS. 3 and 4.

Each actuator control system 251A, 251B, 251C may also be in communication with a sensor 280, such as a pressure transducer, that is configured to measure pressure within a fluid line 15 that is downstream of and in fluid communication with the frac tree 10. Although only one sensor 280 is shown, any number of sensors 280 may be use and located at any number of locations upstream and/or downstream of the protection system 30 and/or any other equipment in fluid communication with the protection system 30.

The sensor 280 provides a signal to at least one of the actuator control systems 251A, 251B, 251C corresponding to the pressure in the fluid line 15. When at least one of the actuator control systems 251A, 251B, 251C receives a signal from the sensor 280 corresponding to a pressure in the fluid line 15 that is greater than or equal to a pre-set pressure (which may be programmed in the control device 300 and/or the controller assembly 330), the actuator control systems 251A, 251B, 251C are configured to close the valves 225A, 225B, 225C. In one embodiment, actuation of the primary valve 225A automatically initiates actuation of one or both of the secondary valves 225B, 225C.

Figure 8:
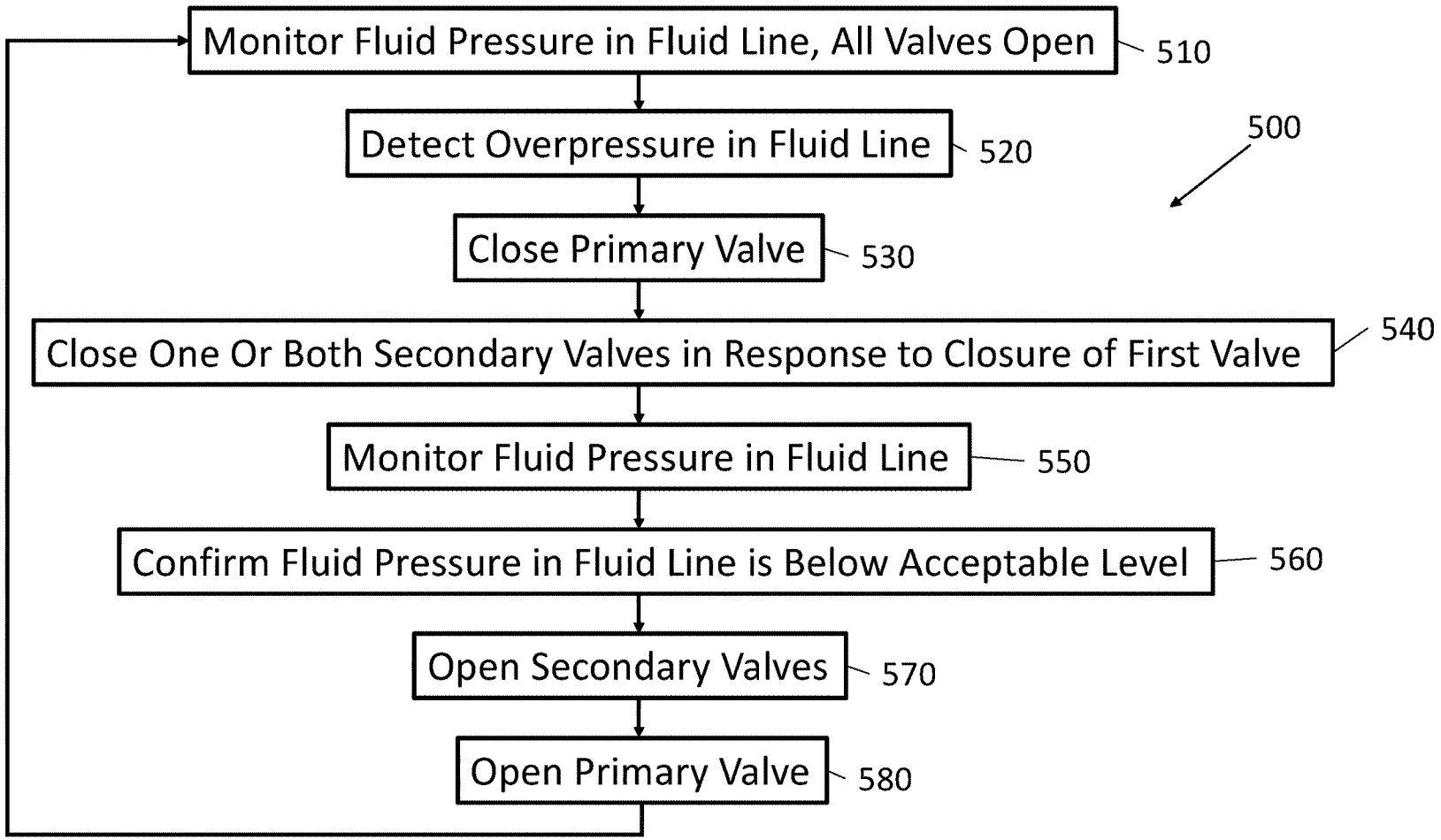
FIG. 8 illustrates a method of closing fluid flow through the high integrity pressure protection system according to one embodiment.

FIG. 8 illustrates a method 500 of closing fluid flow through the high integrity pressure protection system 30 in response to detecting an over pressurization in a fluid line, such as fluid line 15 as illustrated in FIG. 7. The method 500 illustrates only one embodiment and may include more or less steps, all of which can be performed in a different order and/or any of which can be repeated.

At step 510, the protection system 30 is monitoring fluid pressure in the fluid line 15. All of the valves 225A, 225B, 225C are maintained in the open position. To open the valves 225A, 225B, 225C, an operator may transmit a signal from the control device 300 to the actuator control systems 251A, 251B, 251C to actuate the valve actuators 220A, 220, 220C to open the valves 225A, 225B, 225C by supplying pressurized fluid to the valve actuators 220A, 220, 220C as described above. Fluid pressure in the fluid line 15 is monitored by the sensor 280, which communicates a signal corresponding to the fluid pressure to the control device 300 and/or the actuator control systems 251A, 251B, 251C.

At step 520, an over pressurization of the fluid line 15 is measured by the sensor and communicated to the control device 300 and/or the actuator control systems 251A, 251B, 251C. An over pressurization may include a pressure in the fluid line 15 that is greater than or equal to a pre-set pressure (which may be programmed in the control device 300 and/or the controller assembly 330).

At step 530, in response to detecting an over pressurization of the fluid line 15, the actuator control system 251A closes the primary valve 225A. The pressurized fluid in the valve actuator 220A is removed to allow the primary valve 225A to be moved into the closed position by a biasing member, such as biasing member 213 described and illustrated with respect to at least FIGS. 3 and 4.

At step 540, one or both of the secondary valves 225B, 225C may be closes in response to the closing of the primary valve 225A. The actuator control system 251A may provide a signal to one or both of the actuator control systems 251B, 251C indicating that the primary valve 225A is being closed.

At step 550, the actuator control systems 251A, 251B, 251C continue to monitor the fluid pressure in the fluid line 15 via the sensor 280. At step 560, the actuator control systems 251A, 251B, 251C may receive a signal from the sensor 280 corresponding to a pressure in the fluid line 15 that is less than or equal to a pre-set pressure, which is below an acceptable level. An operator and/or the actuator control systems 251A, 251B, 251C (via the control device 300 and/or the controller assembly 300 for example) may confirm that the fluid pressure in the fluid line 15 is below the acceptable level.

At step 570, the actuator control systems 251B, 251C open the secondary valves 225B, 225C, respectively, by suppling pressurized fluid to the valve actuators 220B, 220C. At step 580, the actuator control system 251A opens the primary valve 225A by suppling pressurized fluid to the valve actuator 220A. With all of the valves 225A, 225B, 225C in the open position, fluid may flow through the protection system 30 under normal operating conditions. The method 500 can be repeated upon detection of another over pressurization of the fluid line 15.

While the foregoing is directed to embodiments of the invention, other and further embodiments of the invention may be devised without departing from the basic scope thereof, and the scope thereof is determined by the claims that follow.

The invention claimed is:

1. A method of blowing out debris or sand from a separation device, comprising:

opening a second valve assembly of a valve control system such that the second valve assembly is not exposed to pressurized fluid from the separation device when opening;

opening a first valve assembly of the valve control system, wherein the first valve assembly is downstream of the separation device and upstream of the second valve assembly and in fluid communication with each;

blowing debris or sand from the separation device through the first valve assembly, the second valve assembly, and through a choke port of a third valve assembly of the valve control system, wherein the third valve assembly is downstream of and in fluid communication with the second valve assembly; then closing the first valve assembly; and then closing the second valve assembly such that the second valve assembly is not exposed to pressurized fluid from the separation device when closing.

2. The method of claim 1, wherein opening the second valve assembly comprises supplying pressurized fluid to a second valve actuator of the second valve assembly to move a second valve of the second valve assembly into an open position to allow fluid flow through the second valve.

3. The method of claim 2, wherein the second valve actuator comprises a piston, a biasing member biasing the piston, and a piston rod coupled to a gate valve of the second valve, and wherein supplying the pressurized fluid forces the piston against a bias force of the biasing member to move the gate valve of the second valve into the open position.

4. The method of claim 3, wherein the pressurized fluid is supplied by an actuator control system in fluid communication with the second valve actuator, wherein the actuator control system comprises a fluid reservoir and a pump assembly configured to pump pressurized fluid from the fluid reservoir to the second valve actuator.

5. The method of claim 4, wherein opening the first valve assembly comprises removing pressurized fluid from a first valve actuator of the first valve assembly to move a first valve of the first valve assembly into an open position to allow fluid flow through the first valve.

6. The method of claim 5, wherein the first valve actuator comprises a piston, a biasing member biasing the piston, and a piston rod coupled to a gate valve of the first valve, and wherein removing the pressurized fluid allows the biasing member to move the piston and the gate valve of the first valve into the open position.

7. The method of claim 6, wherein the pressurized fluid from the first valve actuator is returned to the fluid reservoir of the actuator control system.

8. The method of claim 7, wherein the choke port of the third valve assembly is formed in a gate valve of the third valve assembly, wherein the gate valve of the third valve assembly further comprises a full bore opening having a diameter greater than a diameter of the choke port, wherein the full bore opening allows fluid flow through the third valve assembly when in an open position.

9. The method of claim 8, wherein closing the first valve assembly comprises supplying pressurized fluid from the fluid reservoir of the actuator control system to the first valve actuator of the first valve assembly to move the gate valve of the first valve into the closed position to prevent fluid flow through the first valve.

10. The method of claim 9, wherein closing the second valve assembly comprises returning pressurized fluid from the second valve actuator of the second valve assembly to the fluid reservoir of the actuator control system to allow the biasing member to move the piston and the gate valve of the second valve into the closed position to prevent fluid flow through the second valve.

11. A control valve system, comprising:

a first valve assembly positioned upstream of and in fluid communication with a second valve assembly, the second valve assembly being positioned upstream of and in fluid communication with a third valve assembly;

the first valve assembly comprising:

a first valve actuator comprising a piston coupled to a gate valve of a first valve via a piston rod to move the gate valve between an open positon and a closed position to open and close fluid flow through the first valve;

the second valve assembly comprising:

a second valve actuator comprising a piston coupled to a gate valve of a second valve via a piston rod to move the gate valve between an open positon and a closed position to open and close fluid flow through the second valve; and the third valve assembly comprising:

a third valve actuator comprising a piston coupled to a gate valve of a third valve via a piston rod to move the gate valve between an open positon and a closed position, wherein the gate valve of the third valve has a choke port to allow fluid flow through the third valve when in the closed position.

12. The control valve system of claim 11, further comprising a first actuator control system in communication with the first valve assembly and the second valve assembly, wherein the first actuator control system is configured to actuate the first and second valve actuators to move the first and second valves between the open position and the closed positon.

13. The control valve system of claim 12, wherein the first actuator control system comprises a fluid reservoir and a pump assembly configured to pump pressurized fluid from the fluid reservoir to the first and second valve actuators.

14. The control valve system of claim 13, wherein the first valve actuator further comprises a biasing member biasing the gate valve of the first valve into the open position, and wherein the second valve actuator further comprises a biasing member biasing the gate valve of the second valve into the closed position.

15. The control valve system of claim 14, further comprising a second actuator control system in communication with the third valve assembly, wherein the second actuator control system is configured to actuate the third valve actuator to move the third valve between the open position and the closed positon.

16. The control valve system of claim 15, wherein the second actuator control system comprises a fluid reservoir and a pump assembly configured to pump pressurized fluid from the fluid reservoir to the third valve actuator.

17. The control valve system of claim 16, wherein the third valve actuator further comprises a biasing member biasing the gate valve of the third valve into the closed position.

18. The control valve system of claim 17, further comprising a control device operable to control the first and second actuator control systems via wired or wireless communication to actuate the first, second, and third valve assemblies.

19. The control valve system of claim 11, wherein at least one of the first, second, and third valve assemblies comprises a double acting valve that is moveable between both the open positon and the closed position by pressurized fluid.

20. The control valve system of claim 11, further comprising a control device in communication with an actuator control system, wherein the control device is configured to operate the actuator control system to actuate at least one of the first, second, and third valve assemblies between the open position and the closed position.

21. A method of closing fluid flow through a pressure protection system, comprising:

monitoring a fluid pressure in a fluid line;

detecting an over pressurization of fluid in the fluid line;

closing a primary valve of the pressure protection system in response to detecting the over pressurization of fluid in the fluid line downstream of the primary valve, wherein the fluid line is in fluid communication with the primary valve;

closing at least one secondary valve of the pressure protection system in response to detecting the closing of the primary valve;

opening the at least one secondary valve when the fluid pressure in the fluid line downstream of the primary valve is below an acceptable level; and then opening the primary valve in response to detecting opening of the at least one secondary valve;

wherein at least one of a control device and an actuator control system of the pressure protection system monitors the fluid pressure in the fluid line and detects the over pressurization of fluid in the fluid line via a sensor configured to measure the fluid pressure in the fluid line; and wherein the over pressurization of fluid in the fluid line comprises a pressure in the fluid line that is greater than or equal to a pre-set pressure programmed in at least one of the control device and the actuator control system.

22. The method of claim 21, wherein the primary valve is closed by removing pressurized fluid from a valve actuator of the primary valve to allow a biasing member of the valve actuator to move a gate valve of the primary valve into a closed positon.

23. The method of claim 22, wherein the pressurized fluid removed from the valve actuator of the primary valve is communicated to a fluid reservoir of the actuator control system.

24. The method of claim 23, wherein the at least one secondary valve is closed by removing pressurized fluid from a valve actuator of the at least one secondary valve to allow a biasing member of the valve actuator to move a gate valve of the secondary valve into a closed positon.

25. The method of claim 24, wherein the pressurized fluid removed from the valve actuator of the at least one secondary valve is communicated to the fluid reservoir of the actuator control system or to a fluid reservoir of another actuator control system that is separate from the actuator control system in communication with the primary valve.

26. The method of claim 25, wherein the at least one secondary valve is opened by supplying pressurized fluid to the valve actuator of the at least one secondary valve from the fluid reservoir of the actuator control system of the primary valve or from the fluid reservoir of the other actuator control system that is separate from the actuator control system in communication with the primary valve, wherein the pressurized fluid forces the gate valve of the secondary valve into the closed positon against the bias of the biasing member.

27. The method of claim 26, wherein the primary valve is opened by supplying pressurized fluid to the valve actuator of the primary valve from the fluid reservoir of the actuator control system of the primary valve, wherein the pressurized fluid forces the gate valve of the primary valve into the closed positon against the bias of the biasing member.

28. The method of claim 21, further comprising communicating a signal from an actuator control system of the primary valve to an actuator control system of the at least one secondary valve indicating that the primary valve is being closed, wherein the actuator control system of the primary valve is configured to open and close the primary valve, wherein the actuator control system of the at least one secondary valve is configured to open and close the at least one secondary valve.

29. A valve control system, comprising:

a first valve assembly located downstream of and in fluid communication with a separation device or a frac tree;

a second valve assembly located downstream of and in fluid communication with the separation device or the frac tree, wherein the first and second valve assemblies are in fluid communication with each other, wherein the second valve assembly comprises a gate valve having a choke port and a full bore opening having a diameter greater than a diameter of the choke port, wherein when the second valve assembly is in an open position, fluid flows through the full bore opening, and wherein when the second valve assembly is in a closed position, fluid flows through the choke port.

30. The valve control system of claim 29, wherein the second valve assembly is located downstream of and in fluid communication with the first valve assembly such that the second valve assembly is not exposed to pressurized fluid from the separation device or the frac tree when the first valve assembly is in a closed position.

31. The valve control system of claim 30, further comprising a middle valve assembly located between the first valve assembly and the second valve assembly, wherein the middle valve assembly is not exposed to pressurized fluid from the separation device or the frac tree when the first valve assembly is in the closed position.

32. A method of controlling fluid flow, comprising:

flowing fluid through a first valve assembly located downstream of and in fluid communication with a separation device or a frac tree;

flowing fluid through a second valve assembly located downstream of and in fluid communication with the separation device or the frac tree, wherein the first and second valve assemblies are in fluid communication with each other, wherein the second valve assembly comprises a gate valve having a choke port and a full bore opening having a diameter greater than a diameter of the choke port, wherein when the second valve assembly is in an open position, fluid flows through the full bore opening, and wherein when the second valve assembly is in a closed position, fluid flows through the choke port.

33. The method of claim 32, further comprising opening the first valve assembly to allow fluid flow through the first valve assembly while the second valve assembly is in the closed position to allow fluid flow through the choke port of the second valve assembly.

34. The method of claim 32, wherein the second valve assembly is located downstream of and in fluid communication with the first valve assembly such that the second valve assembly is not exposed to pressurized fluid from the separation device or the frac tree when the first valve assembly is in a closed position.

35. The method of claim 34, further comprising a middle valve assembly located between the first valve assembly and the second valve assembly, wherein the middle valve assembly is not exposed to pressurized fluid from the separation device or the frac tree when the first valve assembly is in the closed position.

* * * * *